United States Patent [19]

Mariani et al.

[11] Patent Number: 4,538,123

[45] Date of Patent: Aug. 27, 1985

[54] DIELECTRIC WAVEGUIDE BANDPASS APPARATUS

[75] Inventors: Elio A. Mariani, Hamilton Square; Richard A. Stern, Allenwood; Richard W. Babbitt, Fair Haven, all of N.J.

[73] Assignee: The United States of America as represented by the Secretary of the Army, Washington, D.C.

[21] Appl. No.: 572,350

[22] Filed: Jan. 20, 1984

[51] Int. Cl.[3] ..... H01P 1/20; H01P 3/16; H01P 1/213

[52] U.S. Cl. ..... 333/208; 333/132; 333/202; 333/248

[58] Field of Search ..... 333/1.1, 2, 3, 100, 333/102, 110, 129, 132, 202, 204–212, 239, 245, 246, 248

[56] References Cited

U.S. PATENT DOCUMENTS 4,415,871 11/1983 Stern et al. ..... 333/248 X
4,468,673 8/1984 Stern et al. ..... 343/785

OTHER PUBLICATIONS

Ohm—"A Broad-Band Microwave Circulator", IRE Trans. on Microwave Theory and Techniques, vol. MTT-4, No. 4, Oct. 1956; pp. 210–217.

Stern et al.—"Dielectric Waveguide Circulator", Conference: 6th International Conference on #Infrared and Millimeter Waves, Miami Beach, Fla., (Dec. 7–12, 1981); 2 pages.

Solbach—"Grating-Tuner in Dielectric Image Line for Integrated Millimeter Wave Circuits", Proc. of the 9th European Microwave Conference, Microwave 79, Brighton, England (Sep. 17–20, 1979); pp. 458–462.

T. Itoh, vol. 4, Infrared and Millimeter Waves, Academic Press, Inc. 1981, Chapter entitled "Dielectric Waveguide-Type Millimeter-Wave Integrated Circuits, pp. 149 and 245–248.

G. L. Matthaei et al., "Some Dielectric-Waveguide Filter Structures", 1983 IEEE MTT-S Digest; pp. 299–301.

R. A. Stern et al., U.S. patent application Ser. No. 310,542, filed 10/1/1981, Dielectric Waveguide Circulator.

R. W. Babbitt et al., U.S. patent application Ser. No. 409,201, filed 8/18/1982, Frequency Scan Antenna Utilizing Supported Dielectric Waveguide.

R. A. Stern et al., U.S. patent application Ser. No. 394,753, filed 7/2/1982, Supported Dielectric Waveguide Transmission Line and Components.

*Primary Examiner*—Marvin L. Nussbaum
*Attorney, Agent, or Firm*—Anthony T. Lane; Jeremiah G. Murray; Robert A. Maikis

[57] ABSTRACT

A millimeter wavelength bandpass filter arrangement is produced by using a first dielectric waveguide as an input for a broadband signal to a ferrite circulator. This signal is delivered to a second dielectric waveguide having a bandstop filter formed therein. The bandstop filter reflects the desired bandpass frequency(s) back to the ferrite circulator where it is delivered to a third dielectric waveguide which is the output for the bandpass frequency(s).

6 Claims, 3 Drawing Figures

DIELECTRIC WAVEGUIDE BANDPASS APPARATUS

The invention described herein may be manufactured, used and licensed by or for the Government for Governmental purposes without the payment to me of any royalties thereon.

BACKGROUND OF THE INVENTION

1. Field of the Invention

This invention relates generally to millimeter wavelength, electromagnetic energy, dielectric waveguide transmission line components, and more particularly to a bandpass filter apparatus.

2. Description of the Prior Art

T. Itoh, in a chapter entitled "Dielectric Waveguide-Type Millimeter-Wave Integrated Circuits", of Vol. 4 of *Infrared and Millimeter Waves,* Academic Press, Inc., 1981, has a section headed Resonators and Filters. The bandpass filters described therein are of the ring resonator type.

G. L. Matthaei et al, in an article entitled "Some Dielectric-Waveguide Filter Structures", describes several dielectric waveguide filters. This article is found in the 1983 IEEE MTT-S Digest. A bandstop filter is formed using notches in the sides. A bandpass filter uses a coupled grating design approach.

R. A. Stern et al, in U.S. patent application Ser. No. 310,542, filed Oct. 13, 1981, entitled "Dielectric Waveguide Circulator", now U.S. Pat. No. 4,415,871 issued Nov. 15, 1983, disclose a millimeter wavelength dielectric circulator of the Y-junction type; however, no bandpass filter apparatus is described herein.

R. W. Babbitt et al, in U.S. patent application Ser. No. 409,201, filed Aug. 18, 1982, entitled "Frequency Scan Antenna Utilizing Supported Dielectric Waveguide", now U.S. Pat. No. 4,468,673 issued Aug. 28, 1984, disclose an antenna structure having periodically spaced transverse slots cut in the upper surface of the waveguide; however, no bandpass filter apparatus is disclosed therein.

R. A. Stern et al, in U.S. patent application Ser. No. 394,753, filed July 2, 1982, entitled "Supported Dielectric Waveguide Transmission Line and Components", now abandoned disclose a dielectric support arrangement for millimeter wavelength dielectric waveguide transmission lines and line components.

SUMMARY OF THE INVENTION

A broadband signal is applied to the input of a dielectric waveguide circulator and sent to a bandstop filter formed in a dielectric waveguide. The bandstop filter will reflect a narrow band of frequencies and pass the remaining frequencies to a load. The reflected frequencies are the desired bandpass frequencies. These are reflected back to the circulator and then to the output of the circulator. The bandpass frequencies are determined by the spacing of transverse slots cut periodically in the top of the dielectric waveguide bandstop filter.

DESCRIPTION OF THE PREFERRED EMBODIMENT

Figure 1:
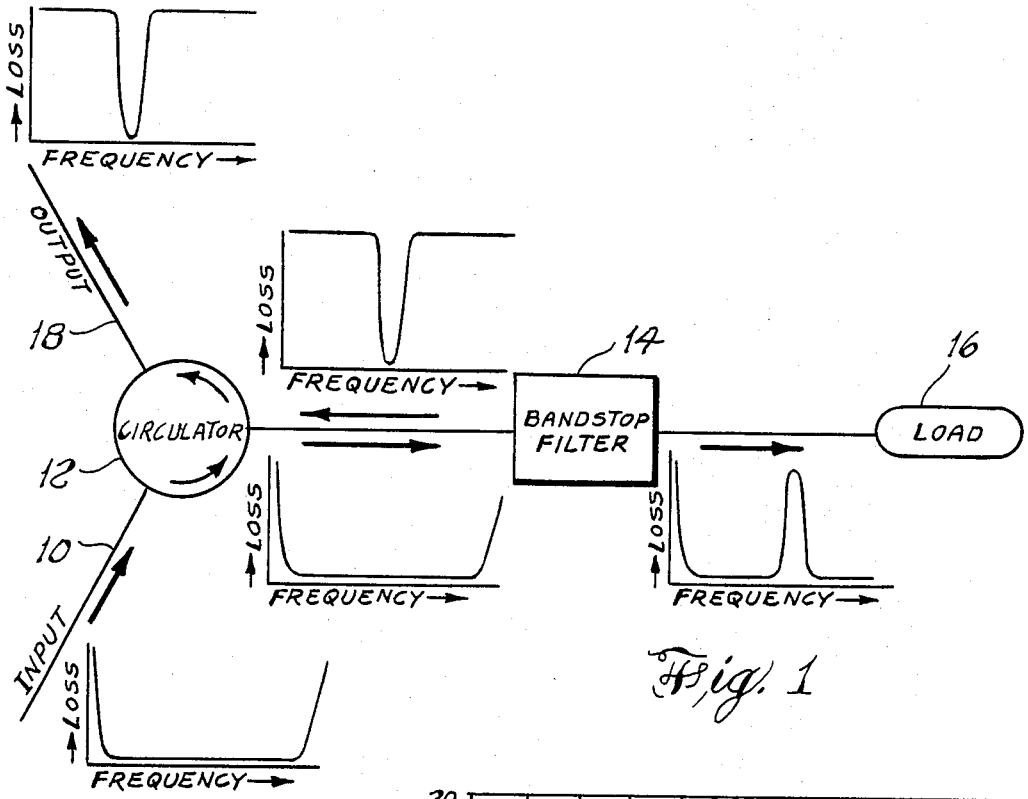
FIG. 1 is a block diagram of a dielectric waveguide bandpass filter apparatus showing the frequencies at various locations in the apparatus.

Referring to FIG. 1, a broadband signal is applied to input 10 of the apparatus. This signal is transmitted to circulator 12 and passed through to bandstop filter 14. As shown, all but a narrow band of frequencies pass through bandstop filter 14 to load 16. A narrow band of frequencies is reflected back from bandstop filter 14 to circulator 12. This narrow band of frequencies passes through circulator 12 to output 18, and is the desired bandpass. In accordance with the invention, therefore, the bandpass frequency is reflected from the bandstop filter while the remaining undesired frequencies pass through.

Figure 2:
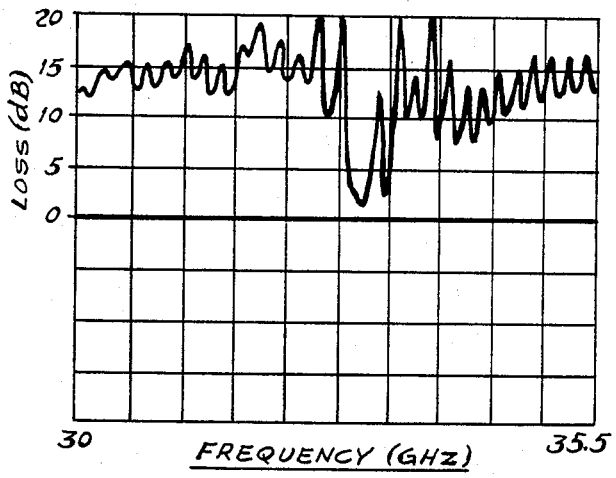
FIG. 2 is a representation of the output characteristics of a bandpass filter apparatus in accordance with the invention.

In FIG. 2, a broadband signal covering the band from 30 to 35.5 GHz was applied to the apparatus of FIG. 1. A narrow band of from about 32.8 to 33.3 GHz is negligibly attenuated while the remaining frequencies show substantial losses. The representation of FIG. 2 is based on a photo taken from an oscilloscope.

Figure 3:
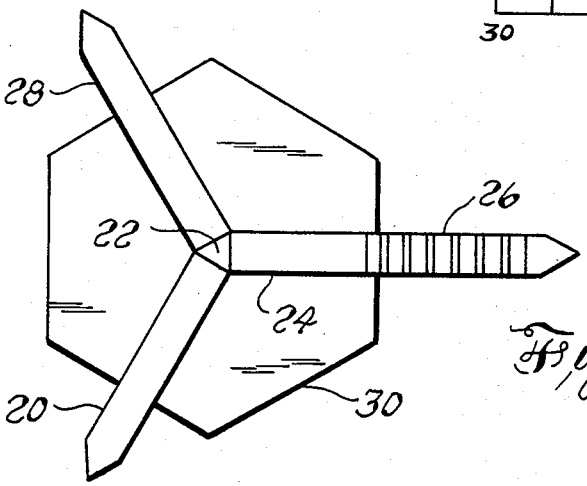
FIG. 3 illustrates the bandpass filter schematically.

Referring now to FIG. 3, a Y-junction circulator is shown having input dielectric waveguide 20 to which the broadband signal is applied. The signal applied to input waveguide passes through ferrite central right prism 22 to dielectric waveguide 24. As shown, dielectric waveguide 24 has a bandstop filter section 26 formed by a series of transverse slots cut in the top of waveguide 24. In accordance with the invention, these slots are spaced from each other a distance equal to the wavelength of the desired bandpass frequency. Because the transverse slots necessarily have a dimension in the direction of the waveguide, a narrow band of frequencies rather than a single frequency will be affected by this spacing of the slots. This narrow band of frequencies will be reflected back to the circulator, passing through ferrite prism 22 to output dielectric waveguide 28. The remaining frequencies of the original broadband signal will pass through bandstop filter section 26 to a load (not shown).

It has been found that each slot contributes to the reflection, so that a series of slots, say twenty, is used to maximize the strength of the reflected narrow band signal.

As shown in FIG. 3, the three dielectric waveguides and central ferrite prism 22 are mounted on hexagonally shaped dielectric plate 30. Dielectric plate 30 provides a rigid mounting for the apparatus which is bonded to it. Such a bonded dielectric support arrangement is more fully disclosed in U.S. patent application Ser. No. 394,753, filed July 2, 1982, now abandoned and referred to in the Background of the Invention.

Although this invention is not directed toward novel dielectric materials it should be understood that the dielectric waveguide bandpass apparatus is fabricated of materials having dielectric constants of from $\epsilon'=9$ to $\epsilon'=40$, while support plate 30 has a dielectric constant of from $\epsilon'=2$ to $\epsilon'=4.3$.

It will be evident from the foregoing, that the apparatus of this invention will not only produce the bandpass frequencies for which it is designed, but the structure employed will be rigid, compact, lightweight, low-cost and compatible with other millimeter wavelength components and systems.

Although a particular embodiment of a dielectric waveguide bandpass apparatus has been illustrated and described, it will be obvious that changes and modifications can be made without departing from the spirit of the invention or the scope of the appended claims.

We claim:

1. Dielectric waveguide bandpass apparatus comprising:

a dielectric waveguide input having one end for receiving a broadband millimeter wavelength signal including the desired bandpass signal;

a right ferrite prism positioned to receive the broadband signal from the other end of said dielectric waveguide input;

a dielectric waveguide bandstop filter element having one end positioned to receive the broadband signal from said right ferrite prism, said dielectric waveguide bandstop filter element having a series of periodically spaced transverse slots cut in its upper surface to reflect a narrow band of frequencies including said desired bandpass signal of said broadband signal back to said right ferrite prism and pass the remaining frequencies of said broadband signal through said dielectric waveguide bandstop filter element to the other end thereof;

a load connected to the other end of said dielectric waveguide bandstop filter element; and a dielectric waveguide output having one end positioned to receive said reflected narrow band of frequencies from said right ferrite prism and the other end for transmitting said narrow band of frequencies.

2. A dielectric waveguide bandpass apparatus in accordance with claim 1 wherein:

said transverse slots are spaced a distance equal to the wavelength of the desired bandpass frequency.

3. A dielectric waveguide bandpass apparatus in accordance with claim 2 wherein:

said dielectric waveguide bandpass apparatus is mounted on a dielectric support plate.

4. Dielectric waveguide bandpass apparatus comprising:

a millimeter wavelength right ferrite circulator prism; and a millimeter wavelength dielectric waveguide bandstop filter element coupled to said circulator prism to receive from said circulator prism a broadband signal and to reflect back to said circulator prism a narrow band signal which is the desired bandpass, said dielectric waveguide bandstop filter element having a series of periodically spaced transverse slots cut in its upper surface.

5. A dielectric waveguide bandpass apparatus in accordance with claim 4 wherein:

said slots are spaced a distance equal to the wavelength of the desired bandpass frequency.

6. A dielectric waveguide bandpass apparatus in accordance with claim 5 wherein:

said dielectric waveguide bandpass apparatus is mounted on a dielectric support plate.

* * * * *